US008015621B2

(12) United States Patent
Udelhofen

(10) Patent No.: US 8,015,621 B2
(45) Date of Patent: Sep. 13, 2011

(54) PROTECTIVE SHOULDER PADS

(75) Inventor: Patrick J. Udelhofen, Chicago, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 748 days.

(21) Appl. No.: 12/077,288

(22) Filed: Mar. 18, 2008

(65) Prior Publication Data

US 2009/0235440 A1 Sep. 24, 2009

(51) Int. Cl.
*A41D 13/00* (2006.01)

(52) U.S. Cl. ..... 2/102

(58) Field of Classification Search ..... 2/102, 94, 2/459, 460–463, 456, 2.5, 44, 45, 267, 268
See application file for complete search history.

(56) References Cited

U.S. PATENT DOCUMENTS

| | | | | | |
|---|---|---|---|---|---|
| 3,431,560 | A * | 3/1969 | Austin | 2/462 |
| 3,740,762 | A | 6/1973 | Truelove | 2/2 |
| 3,740,763 | A | 6/1973 | Mitchell | 2/2 |
| 4,292,687 | A * | 10/1981 | Daverport, Jr. | 2/462 |
| 5,187,812 | A | 2/1993 | Neuhalfen | 2/2 |
| 5,390,368 | A * | 2/1995 | Chang | 2/462 |
| 5,398,339 | A | 3/1995 | Wagner | 2/2 |
| 5,487,187 | A | 1/1996 | Zide et al. | 2/2 |
| 5,557,802 | A | 9/1996 | Wickert | 2/2 |
| 5,987,654 | A * | 11/1999 | Chartrand | 2/462 |
| 6,247,188 | B1 | 6/2001 | Beland | 2/461 |
| 6,961,957 | B2 | 11/2005 | Carlson | 2/2.5 |
| 2005/0210569 | A1 | 9/2005 | Panzenbock et al. | 2/463 |

* cited by examiner

*Primary Examiner* — Tejash Patel

(74) *Attorney, Agent, or Firm* — Terence P. O'Brien

(57) ABSTRACT

A protective shoulder pad assembly for use in contact sports. The shoulder pad assembly includes a flexible vest, a pair of rigid shoulder pads attached to the vest, and a pair of straps extending from a back side of the vest. The straps can each be refastenably attached to a front side of the vest. In particular, the straps can be crossed over one another in an "X" configuration on the front side of the vest, thereby directly securing each strap to both a front right portion and a front left portion of the vest.

24 Claims, 5 Drawing Sheets

PROTECTIVE SHOULDER PADS

FIELD OF THE INVENTION

The present invention relates to protective shoulder pads for use in sports.

BACKGROUND OF THE INVENTION

Protective shoulder pads are worn by players in a number of contact sports, such as football, hockey, and lacrosse. Because of the physical nature of such sports, it is important for the protective gear to fit the players with the protective padding aligned with the intended areas on the players' bodies. Misaligned protective gear could jeopardize a player's safety. It is also important for the protective gear to fit comfortably. An uncomfortable fit could hinder a player's performance.

Athletes of all shapes and sizes are expected to wear essentially the same protective gear in many contact sports leagues. Conventional shoulder pads typically include a lace-up closure in the front, which can be loosened or tightened to accommodate a player's chest size. However, the adjustability of the lace-up closure does not address height differences among players. Consequently, shoulder pads that include merely a lace-up closure in the front may tend to "ride up" on taller players. Furthermore, the process of donning lace-up shoulder pads is time-consuming, and simply adjusting lace-up shoulder pads is time-consuming as well.

It would thus be desirable to provide a protective shoulder pad assembly that can be adjusted to fit athletes in a wide range of both height and girth. In doing so, it would also be desirable to provide a protective shoulder pad assembly that can be adjusted quickly and easily.

SUMMARY OF THE INVENTION

The present invention presents a protective shoulder pad assembly for use in contact sports. The protective shoulder pad assembly features straps that can adjust the fit of the assembly both horizontally and vertically in order to accommodate players in a wide range of sizes.

The shoulder pad assembly includes a flexible vest and a pair of rigid shoulder pads attached to the vest. A pair of straps extends from a back portion of the vest and is refastenably attached to a front portion of the vest. More particularly, a first strap extending from a back right side of the vest is refastenably attached to a front right side of the vest, and a second strap extending from a back left side of the vest is refastenably attached to a front left side of the vest. The front of the vest also includes a portion on the front left side to which the first strap may be refastenably attached and a portion on the front right side to which the second strap may be refastenably attached. Thus, the two straps can be crossed over one another in an "X" configuration and refastenably attached to the front portion of the vest, thereby directly securing each strap to both a front right portion and a front left portion of the vest. Additionally, the two straps can be refastenably attached to one another when crossed over one another on the front of the vest.

Although the straps are capable of crossing over one another in the front and being refastenably attached to opposite sides of the front of the vest, the straps do not need to be crossed over one another in order to secure the shoulder pad assembly to the wearer. One of the attributes of the design is that the shoulder pad assembly can be adjusted to fit a wide range of wearers. Thus, a smaller or thinner player would be able to wear the shoulder pad assembly with the straps crossed over one another in the front and refastenably attached to opposite front portions of the vest, while a more robust player could wear the same shoulder pad assembly with the strap that extends from the back right side refastenably attached to the front right side of the vest and the strap that extends from the back left side refastenably attached to the front left side of the vest and no overlapping of the straps in the front.

The first strap and the second strap may be the only straps extending from the back of the vest to the front of the vest. In certain embodiments, the two straps are each permanently attached to the back of the vest. Alternatively, the two straps may be refastenably attached to the back of the vest. Additionally, the two straps may each be adjustable in length. The two straps and the front of the vest may include hook-and-loop fasteners for the refastenable attachment areas.

The shoulder pad assembly suitably includes a fastening component attached to a central edge of the front right side of the vest and a mating fastening component attached to a central edge of the front left side of the vest. The fastening component and the mating fastening component are releasably engageable and can form a closure between the front right side of the vest and the front left side of the vest. This closure, when formed of hook-and-loop fasteners for example, can be adjustable with respect to the circumferential distance about a wearer's chest. This closure can also maintain the shoulder pad assembly in place on a wearer prior to fastening the straps to the front of the vest.

The rigid shoulder pads may each include a rigid upper shoulder pad and a rigid lower shoulder pad operatively connected to one another. For example, the upper shoulder pad may be secured to the vest atop the shoulder while the lower shoulder pad is connected to the vest by a strap. The lower shoulder pads may hang somewhat freely above the wearer's biceps, thus protecting the wearer while not hindering the wearer's freedom of movement.

A pair of inner pads may be attached to an inner surface of the flexible vest. The inner pads may be refastenably attached to the vest, thereby allowing the inner pads to be removed or replaced. For example, the inner pads may be available in a variety of sizes, and the inner pads of different sizes may each be releasably engageable with the inner surface of the flexible vest. Thus, a player may opt for thicker or thinner pads, or larger or smaller pads. Juvenile teams with limited amounts of protective gear may particularly benefit from the convenience of being able to adjust the shoulder pad assembly to accommodate wearers in a wide range of sizes, as well as wearers who vary in their preference of pad thicknesses. Additionally, the inner pads may be machine-washable.

Any one or more of the shoulder pad assembly embodiments described herein may be used in football, hockey, lacrosse, and any other contact sport. The shoulder pad assembly provides a wide range of size adjustability, and allows the adjustments to be made quickly and easily.

DETAILED DESCRIPTION OF THE INVENTION

Figure 1:
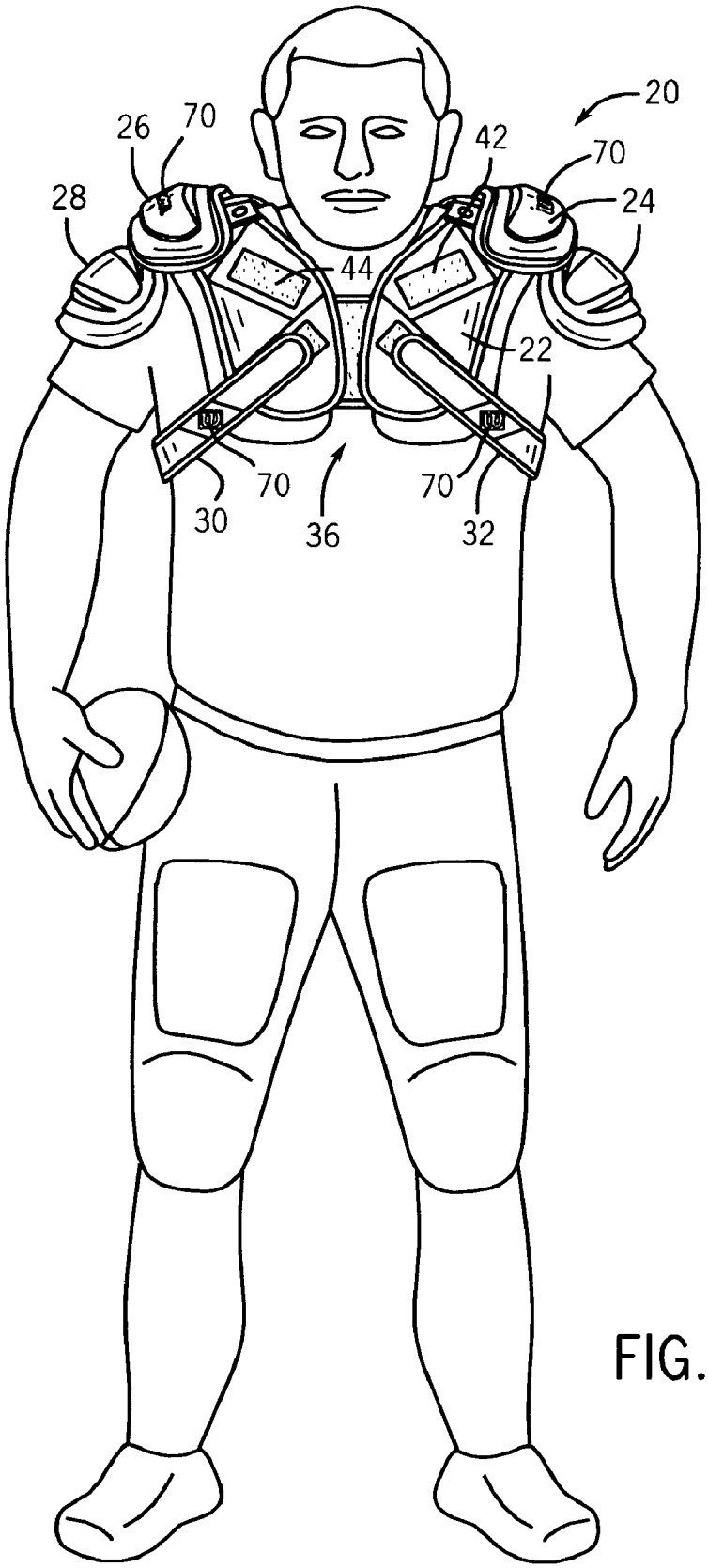
FIG. 1 is a perspective view of a shoulder pad assembly worn by a football player.

Referring to FIG. 1, a protective shoulder pad assembly is indicated generally at 20. The adjustability of the shoulder pad assembly 20 provides a comfortable fit on athletes in a wide range of sizes. Additionally, an adjustable strap system allows adjustments to be made quickly and easily.

Figure 2:
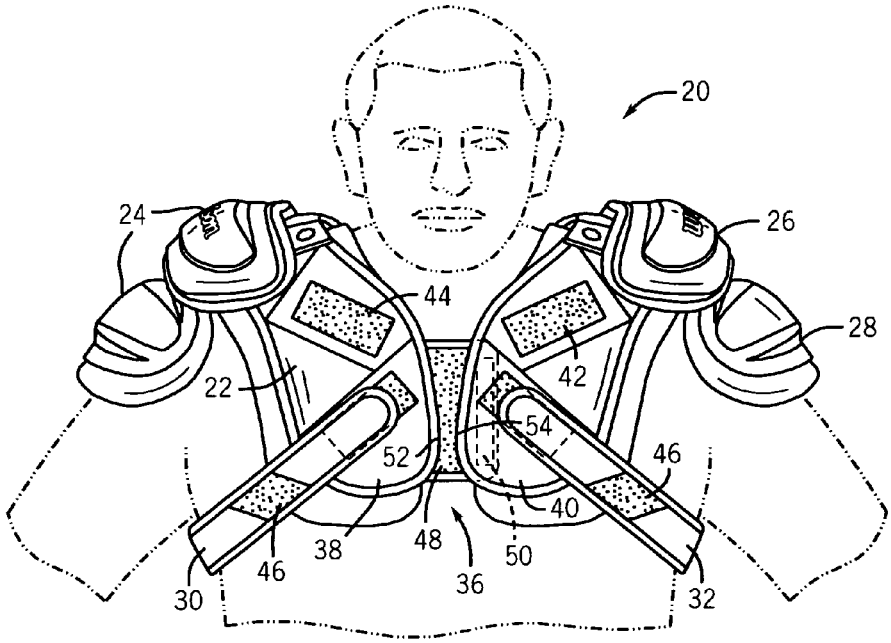
FIG. 2 is a perspective view of a shoulder pad assembly worn by a relatively large athlete.
Figure 4:
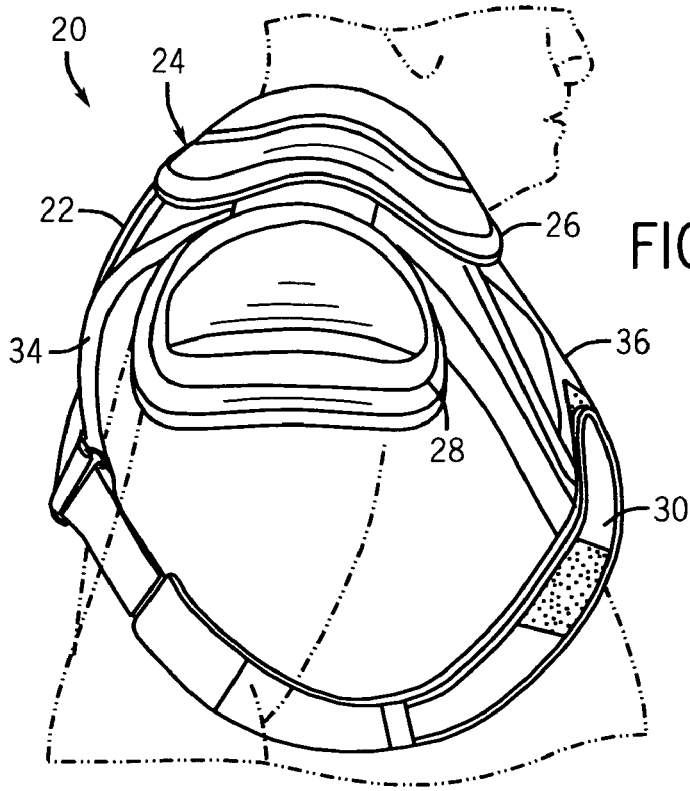
FIG. 4 is a side view of the shoulder pad assembly in FIG. 2.

The shoulder pad assembly 20 includes a flexible vest 22 and a pair of rigid shoulder pads 24 attached to the vest 22. A pair of straps 30, 32 extends from a back portion 34 of the vest 22 and is refastenably attached to a front portion 36 of the vest 22. More particularly, a first strap 30 extending from a back right side of the vest 22 is refastenably attached to a front right side 38 of the vest 22, and a second strap 32 extending from a back left side of the vest 22 is refastenably attached to a front left side 40 of the vest 22. In alternative preferred embodiments, the straps 30 and 32 can be fixedly or removably coupled to other locations on the flexible vest (e.g., front, side, etc.). As illustrated in FIGS. 2 and 4, the shoulder pad assembly 20 can accommodate a relatively large athlete, with the straps 30, 32 extending from the back portion 34 of the vest 22, under the wearer's arms, and up to the front portion 38 of the vest 22, thus providing both horizontal and vertical adjustability. The multidirectional adjustability provides a comfortable secure fit for the athletes of varying sizes.

Figure 3:
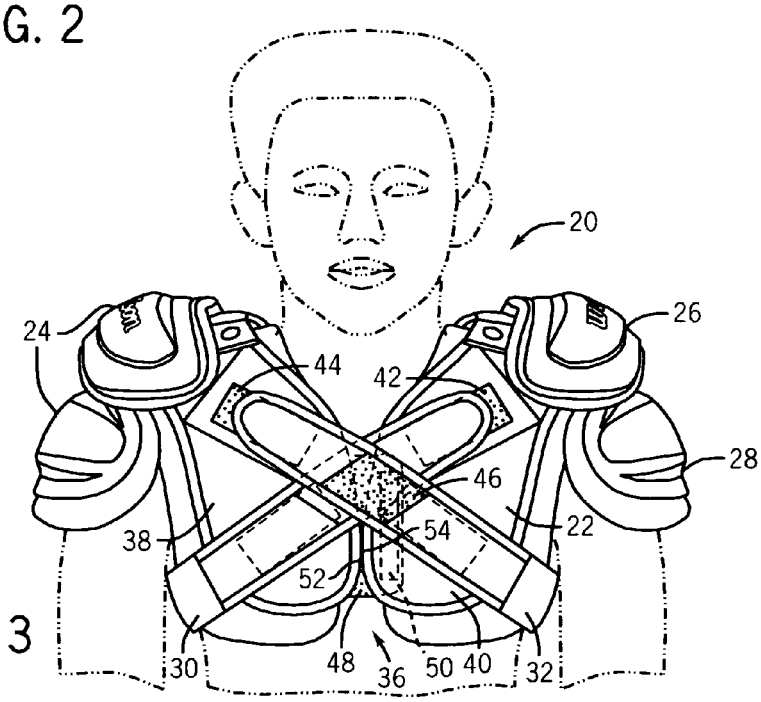
FIG. 3 is a perspective view of a shoulder pad assembly worn by a relatively small athlete.

Additionally, the front 36 of the vest 22 also includes a portion 42 on the front left side to which the first strap 30 may be refastenably attached and a portion 44 on the front right side to which the second strap 32 may be refastenably attached. The portion 44 can take the form of a patch or may extend about larger areas of the outer surface of the front side of the vest, up to and including the entire outer surface of the front side of the vest. Thus, as illustrated in FIG. 3, the two straps 30, 32 can be crossed over one another in an "X" configuration and refastenably attached to the front portion 36 of the vest 22, thereby directly securing each strap 30, 32 to both a front right side 38 and a front left side 40 of the vest 22. The two straps 30, 32 can also be refastenably attached to one another when crossed over one another on the front of the vest 22.

Figure 5:
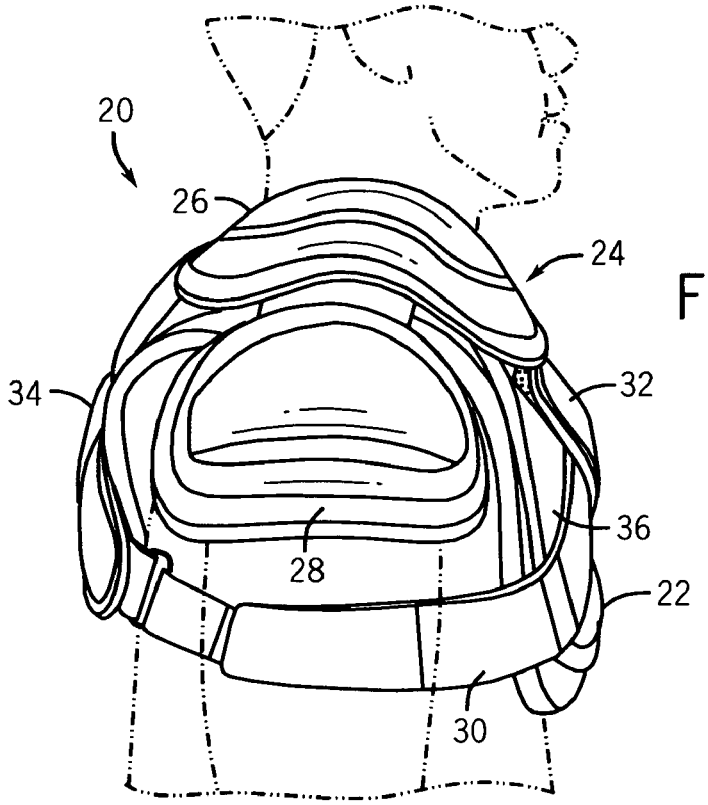
FIG. 5 is a side view of the shoulder pad assembly in FIG. 3.

Although the straps 30, 32 are capable of crossing over one another in the front and being refastenably attached to opposite sides of the front 36 of the vest 22, the straps 30, 32 do not need to be crossed over one another in order to secure the shoulder pad assembly 20 to the wearer. One of the attributes of the design is that the shoulder pad assembly 20 can be adjusted to fit a wide range of wearers. Thus, a smaller or thinner player would be able to wear the shoulder pad assembly 20 with the straps 30, 32 crossed over one another in the front 36 and refastenably attached to opposite front portions of the vest 22 (FIGS. 3 and 5), while a more robust player could wear the same shoulder pad assembly 20 with the strap 30 that extends from the back right side refastenably attached to the front right side 38 of the vest 22 and the strap 32 that extends from the back left side refastenably attached to the front left side 40 of the vest 22 with no overlapping of the straps 30, 32 in the front (FIGS. 2 and 4). The increased flexibility enables a single set of shoulder pads to accommodate the needs of athletes of varying body types and sizes.

Whether the straps 30, 32 are crossed over one another in an "X" configuration or not, the ends of the straps 30, 32 are attached to the front 36 of the vest 22 at an angle that is non-parallel with the wearer's waist. More particularly, the ends of the straps 30, 32 are attached to the front 36 of the vest 22 at an angle between about 15 degrees and 55 degrees from the wearer's waist, with the wearer's waist being essentially horizontal. In other preferred embodiments, the straps can be positioned to extend at an angle less than or greater than the range of 15-55 degrees. In other embodiments, the strap or straps can extend in a generally horizontal position.

The wrap-around design of the straps 30, 32 with the angled attachment to the front 36 of the vest 22 provides both a horizontal and vertical distribution of forces regardless of the size of the wearer. Thus, the first strap 30 and the second strap 32 may be the only straps extending from the back 34 of the vest 22 to the front 36 of the vest 22, in contrast with strap systems that require one set of straps to hold the vest in place horizontally and a second set of straps that anchor the vest vertically. In certain embodiments, the two straps 30, 32 are each permanently attached to the back 34 of the vest 22, or are otherwise integral with the back 34 of the vest 22. Alternatively, the two straps 30, 32 may be refastenably attached to the back 34 of the vest 22, such that the pair of straps 30, 32 may be interchangeable with other pairs of straps of varying lengths or stretchability, for example. Additionally, the two straps 30, 32 may each be adjustable in length.

The adjustable strap system renders the shoulder pad assembly 20 beneficial for both professional and non-professional sports. For professional athletes in particular, the ease of donning and adjusting the shoulder pad assembly 20 requires less time and concentration compared to prior art shoulder pad assemblies that include a lace-up front closure. In juvenile sports leagues, equipment is often limited and thus shared among players. The adjustability of the shoulder pad assembly 20 that enables one size assembly 20 to accommodate a wide range of users can reduce equipment costs by allowing a team to share a smaller number of shoulder pad assemblies 20.

The vest 22 and the straps 30, 32 can be made primarily of a flexible material, such as nylon, cotton, or other suitable synthetic or natural materials, or combinations thereof. The vest 22 and/or straps 30, 32 may also include padding for additional comfort and shock absorption. Structural enhancements, such as rigid plastic shoulder arches, may be either permanently or refastenably attached to the vest 22 with rivets, hook-and-loop fasteners, or other fastening devices. The vest 22 and/or straps 30, 32 may include elastomeric materials for enhanced conformity about a wearer's body.

Figure 6:
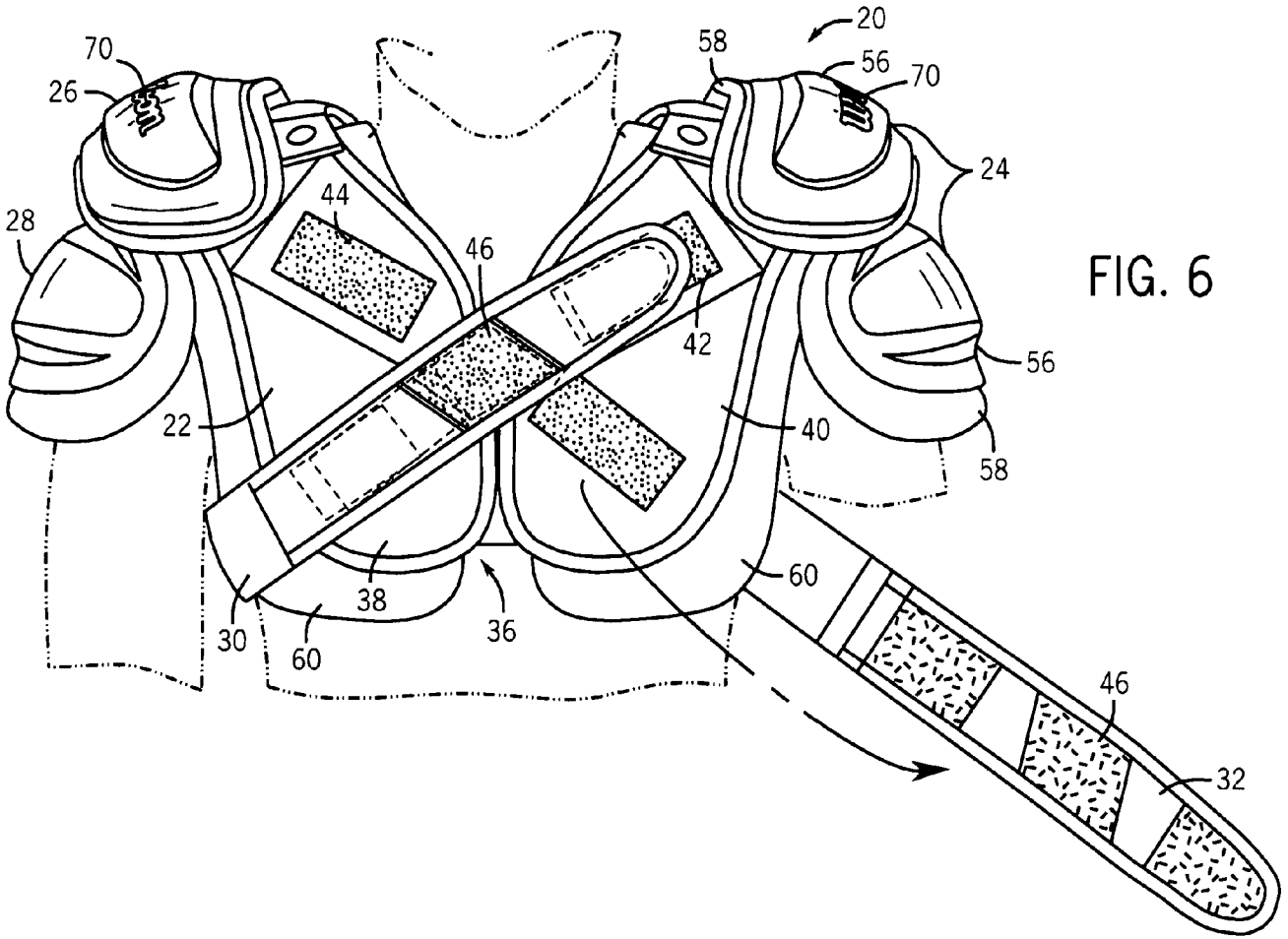
FIG. 6 is a perspective view of a shoulder pad assembly illustrating the refastenability of the straps.

As used herein, the terms "refastenably attached," "releasably engageable," and the like, refer to elements that can be fastened and unfastened an unlimited number of times without damaging the fastening components or the substrates to which the fastening components are affixed. The two straps 30, 32 and the front 36 of the vest 22 may include hook-and-loop fasteners, such as Velcro® hook-and-loop fasteners, for the refastenable attachment areas. Alternatively, the refastenable attachment areas may include buttons, snaps, buckles, or any other suitable type of fastening mechanism. As noted above, the two straps 30, 32 can be refastenably attached to one another when crossed over one another on the front 36 of the vest 22. The straps 30, 32 may each include fastening components and mating fastening components on the interior sides and exterior sides of the cross-over zones 46 of the straps 30, 32 to allow either right-over-left or left-over-right attachment configurations. FIG. 6 illustrates the unfastening of a shoulder pad assembly 20 in which a left strap 32 is fastened over a right strap 30.

In addition to the strap system, the shoulder pad assembly 20 suitably includes at least one fastener coupling central edge regions 52 and 54 of the front right side 38 and the front left side 40 of the vest. In one preferred embodiment, a fastening component 48 can be attached to the central edge region 52 of the front right side 38 of the vest 22 and a mating fastening component 50 can be attached to the central edge region 54 of the front left side 40 of the vest 22. The fastening component 48 and the mating fastening component 50 are releasably engageable and can form a closure between the front right side 38 of the vest 22 and the front left side 40 of the vest 22. This closure, when formed of hook-and-loop fasteners for example, can be adjustable with respect to the circumferential distance about a wearer's chest. For example, on a larger wearer as in FIG. 2, the distance between the front right side 38 of the vest 22 and the front left side 40 of the vest 22 is maximized, while on a thinner wearer as in FIG. 3, the distance between the front right side 38 of the vest 22 and the front left side 40 of the vest 22 is minimized. As illustrated in FIGS. 2 and 3, the fastening component 48 and mating fastening component 50 do not have to be attached directly to the central edge region 52 of the front right side 38 of the vest 22 and the central edge region 54 of the front left side 40 of the vest 22, respectively. As shown, the fastening component 48 may extend outward from the central edge region 52 of the front right side 38 of the vest 22 while the mating fastening component 50 is positioned on an inner surface of the vest 22 a short distance from the central edge region 54 of the front left side 40 of the vest 22, or any similar configuration. This closure can also maintain the shoulder pad assembly 20 in place on a wearer prior to fastening the straps 30, 32 to the front 36 of the vest 22. In alternative embodiments, other forms of fastening components can be used to couple the front left and right sides of the vest, such as, for example, buckles, tongue and groove connectors, ties, buttons, laces, etc.

The rigid shoulder pads 24 may each include a rigid upper shoulder pad 26 and a rigid lower shoulder pad 28 operatively connected to one another. For example, the upper shoulder pad 26 may be secured to the vest 22 atop the shoulder, such as with nylon straps riveted to the vest 22 and/or nylon straps refastenably attached to the vest 22 with hook-and-loop fasteners, while the lower shoulder pad 28 is connected to the vest 22 by a nylon strap sewn or otherwise secured to the vest 22 or the upper shoulder pad 26. The lower shoulder pads 28 may hang somewhat freely above the wearer's biceps, thus protecting the wearer while not hindering the wearer's freedom of movement. The rigid shoulder pads 24 may be molded from relatively rigid plastic and attached to a padded layer 58 positioned between the wearer and the molded plastic shell 56, as shown in FIG. 6. In other preferred embodiments, one or more rigid pads can be attached to the front or rear of the vest to provide further impact protection to the user.

Additionally, one or more of the vest 22 or the pads 24 and 26 can include indicia 70 indicative of a logo, a trademark, instructions, a design or other configuration. Further the vest 22 and the pads 24 and 26 can be formed in a variety of different colors, color combinations or design patterns.

Figure 7:
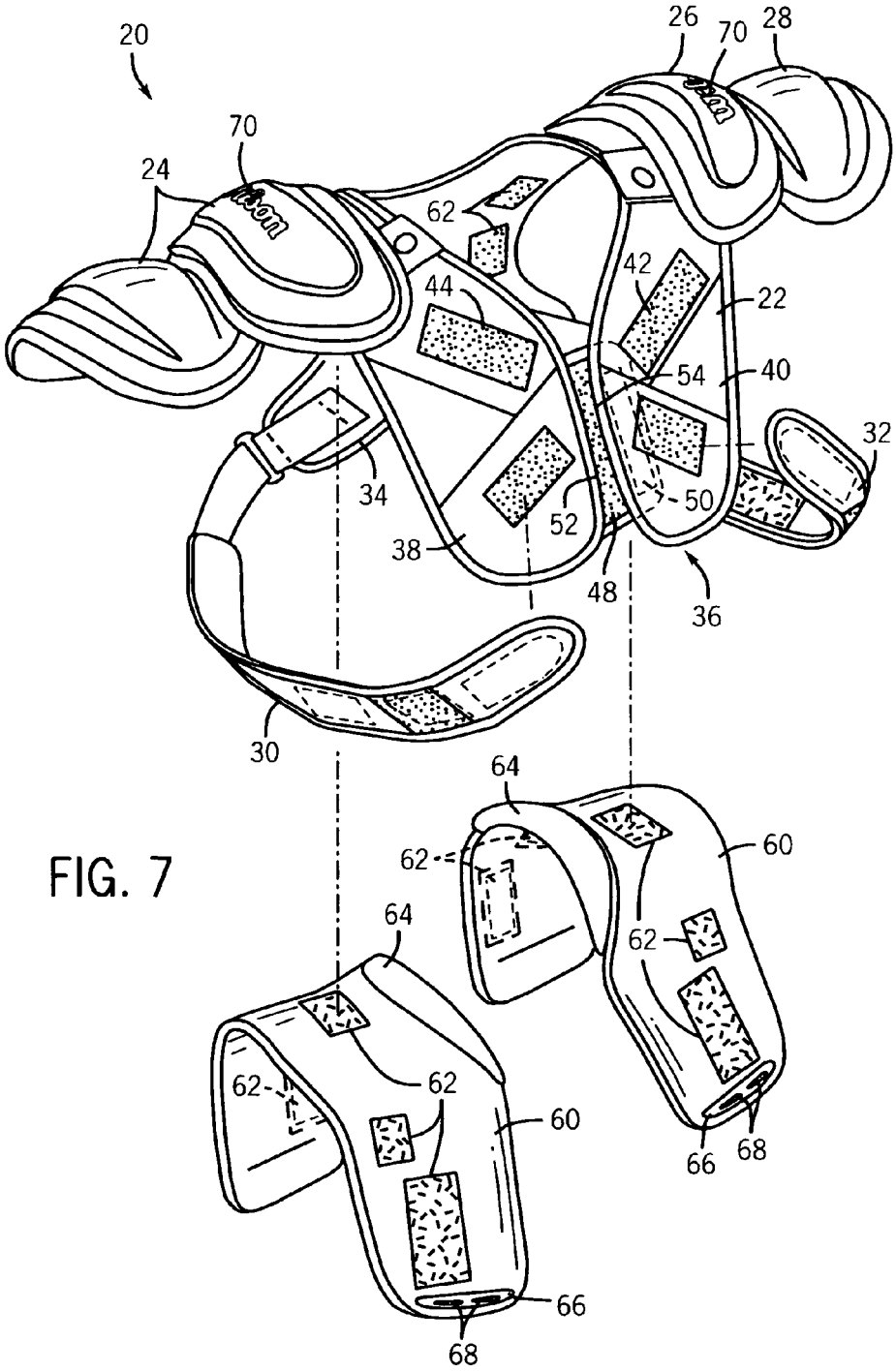
FIG. 7 is an exploded view of a shoulder pad assembly and corresponding inner pads.

One or more inner pads 60 may be attached to an inner surface of the flexible vest 22. As illustrated in FIG. 7, a pair of inner pads 60 may be refastenably attached to the vest 22, such as with hook-and-loop fasteners 62, thereby allowing the inner pads 60 to be removed or replaced. For example, the inner pads 60 may be available in a variety of sizes, and the inner pads 60 of different sizes may each be releasably engageable with the inner surface of the flexible vest 22. The fasteners 62 can be configured in the form of discrete spaced apart patches or the outer surface of the vest in part or as a whole can be formed of a loop and/or hook type material. In still other preferred embodiments, other types fasteners can be used to attach or couple the inner pad(s) to the vest. Thus, a player may opt for thicker or thinner pads, or larger or smaller pads. Juvenile teams with limited quantities of protective gear may particularly benefit from the convenience of being able to adjust the shoulder pad assembly 20 to accommodate wearers in a wide range of sizes, as well as wearers who vary in their preference of pad thicknesses. Furthermore, the ability to quickly replace sweat-soaked inner pads with a clean set of pads allows for extended use of the shoulder pad assembly 20 during play. Additionally, the inner pads 60 may be machine-washable, thus allowing for easy maintenance.

The inner pads 60 may be formed of virtually any compressible and resilient material, such as polyurethane foam, and may be surrounded by polyester or other suitable outer covering. The inner pads 60 may provide additional neck padding 64, as shown in FIG. 7. Additionally, the inner pads 60 may include anchors 66 to which rib pads or other protective padding may be tethered. For example, the anchors 66 may be molded from a relatively rigid plastic and sewn to the inner pads 60 such that straps extending from the rib pads may be inserted through slots 68 in the anchors 66 and fastened to the rib pads.

Any one or more of the protective shoulder pad assembly embodiments described herein may be used in football, hockey, lacrosse, and any other contact sport. In particular, the shoulder pad assembly 20 may be used in organized professional league sports and/or in competitive play. Regardless of the sport, the shoulder pad assembly 20 provides a wide range of size adjustability, and allows the adjustments to be made quickly and easily.

While the preferred embodiments of the invention have been illustrated and described, it will be appreciated that various changes can be made therein without departing from the spirit and scope of the invention. For example, while the embodiments described herein are illustrated in a shoulder pad assembly for a football player, the principles of the present invention could also be used for protective shoulder pad assemblies in practically any other type of contact sport. Accordingly, it will be intended to include all such alternatives, modifications and variations set forth within the spirit and scope of the appended claims.

What is claimed is:

1. A shoulder pad assembly comprising:

a flexible vest having a back side, a right front side and a left front side;

a pair of rigid shoulder pads coupled to the vest;

a first strap extending from a first location on the back side of the vest and refastenably attached to the right front side of the vest; and a second strap extending from a second location on the back side of the vest and refastenably attached to the left front side of the vest;

at least a portion of the left front side being configured to releasably engage the first strap, and at least a portion of the right front side being configured to releasably engage the second strap, wherein the first strap and the second strap can be crossed over one another in an "X" configuration and wherein the first and second straps can be refastenably attached to one another on the front of the vest.

2. A shoulder pad assembly comprising:

a flexible vest having a back side, a right front side and a left front side;

a pair of rigid shoulder pads coupled to the vest;

a first strap extending from a first location on the back side of the vest and refastenably attached to the right front side of the vest;

a second strap extending from a second location on the back side of the vest and refastenably attached to the left front side of the vest;

at least a portion of the left front side being configured to releasably engage the first strap, and at least a portion of the right front side being configured to releasably engage the second strap; and at least one fastener configured to releasably engage a first central edge region of the right front side and a second central edge region of the left front side;

wherein the at least one fastener includes a fastening component attached to the first central edge region and a mating fastening component attached to the second central edge region, and the fastening component and the mating fastening component are releasably engageable to form a closure between the front right side of the vest and the front left side of the vest.

3. A shoulder pad assembly comprising:

a flexible vest having a back side, a right front side and a left front side;

a pair of rigid shoulder pads coupled to the vest;

a first strap extending from a first location on the back side of the vest and refastenably attached to the right front side of the vest; and a second strap extending from a second location on the back side of the vest and refastenably attached to the left front side of the vest;

at least a portion of the left front side being configured to releasably engage the first strap, and at least a portion of the right front side being configured to releasably engage the second strap, wherein the first strap and the second strap are the only straps extending from the back of the vest to the front of the vest.

4. A shoulder pad assembly comprising:

a flexible vest;

a pair of rigid shoulder pads attached to the vest; and a pair of straps, each strap having a first end coupled to a back portion of the vest and a second end refastenably attached to a front portion of the vest;

wherein the two straps can be crossed over one another in an "X" configuration and refastenably attached to the front portion of the vest, thereby directly securing each strap to both a front right portion and a front left portion of the vest, wherein the first strap and the second strap can be refastenably attached to one another on the front of the vest.

5. A shoulder pad assembly comprising:

a flexible vest;

a pair of rigid shoulder pads attached to the vest; and a pair of straps, each strap having a first end coupled to a back portion of the vest and a second end refastenably attached to a front portion of the vest;

wherein the two straps can be crossed over one another in an "X" configuration and refastenably attached to the front portion of the vest, thereby directly securing each strap to both a front right portion and a front left portion of the vest;

wherein the front portion of the vest includes left and right front sides, and wherein the shoulder pad assembly further comprises at least one fastener configured to releasably engage a first central edge region of the right front side and a second central edge region of the left front side; and wherein the at least one fastener includes a fastening component attached to a central edge region of the front right side of the vest and a mating fastening component attached to a central edge region of the front left side of the vest, and the fastening component and the mating fastening component are releasably engageable to form a closure between the front right side of the vest and the front left side of the vest.

6. The shoulder pad assembly of claim 1, wherein each rigid shoulder pad comprises at least a rigid upper shoulder pad and a rigid lower shoulder pad operatively coupled to one another.

7. The shoulder pad assembly of claim 1, further comprising at least one inner pad coupled to an inner surface of the flexible vest.

8. The shoulder pad assembly of claim 7, wherein the at least one inner pad is refastenably attached to the inner surface of the flexible vest.

9. The shoulder pad assembly of claim 8, wherein the inner pads are available in a variety of sizes, and the inner pads of different sizes are each releasably engageable with the inner surface of the flexible vest.

10. The shoulder pad assembly of claim 7, wherein the at least one inner pad is machine-washable.

11. The shoulder pad assembly of claim 2, further comprising at least one inner pad coupled to an inner surface of the flexible vest.

12. The shoulder pad assembly of claim 11, wherein the at least one inner pad is refastenably attached to the inner surface of the flexible vest.

13. The shoulder pad assembly of claim 12, wherein the inner pads are available in a variety of sizes, and the inner pads of different sizes are each releasably engageable with the inner surface of the flexible vest.

14. The shoulder pad assembly of claim 11, wherein the at least one inner pad is machine-washable.

15. The shoulder pad assembly of claim 3, wherein the first strap and the second strap can be crossed over one another in an "X" configuration.

16. The shoulder pad assembly of claim 3, wherein the first strap and the second strap are each permanently attached to the back of the vest.

17. The shoulder pad assembly of claim 3, wherein the first strap and the second strap are each refastenably attached to the back of the vest.

18. The shoulder pad assembly of claim 3, wherein the first strap, the second strap, and the front of the vest comprise hook-and-loop fasteners for the refastenable attachments.

19. The shoulder pad assembly of claim 4, wherein each rigid shoulder pad comprises at least a rigid upper shoulder pad and a rigid lower shoulder pad operatively coupled to one another.

20. The shoulder pad assembly of claim 4, further comprising at least one inner pad coupled to an inner surface of the flexible vest.

21. The shoulder pad assembly of claim 4, wherein at least one of the shoulder pads, the vest and the first and second straps includes graphical and/or alphanumeric indicia.

22. The shoulder pad assembly of claim 5, wherein each rigid shoulder pad comprises at least a rigid upper shoulder pad and a rigid lower shoulder pad operatively coupled to one another.

23. The shoulder pad assembly of claim 5, further comprising at least one inner pad coupled to an inner surface of the flexible vest.

24. The shoulder pad assembly of claim 5, wherein at least one of the shoulder pads, the vest and the first and second straps includes graphical and/or alphanumeric indicia.

* * * * *